US010370173B2

(12) United States Patent
Tanaka et al.

(10) Patent No.: US 10,370,173 B2
(45) Date of Patent: Aug. 6, 2019

(54) VISCOUS MATERIAL FEED APPARATUS AND VISCOUS MATERIAL FEED METHOD

(71) Applicant: THREE BOND CO., LTD., Hachioji-shi, Tokyo (JP)

(72) Inventors: Hirohiko Tanaka, Tokyo (JP); Shigeyuki Ohno, Tokyo (JP); Hajime Kibe, Tokyo (JP)

(73) Assignee: THREE BOND CO., LTD., Tokyo (JP)

( * ) Notice: Subject to any disclaimer, the term of this patent is extended or adjusted under 35 U.S.C. 154(b) by 0 days.

(21) Appl. No.: 15/759,480

(22) PCT Filed: May 9, 2016

(86) PCT No.: PCT/JP2016/063780
§ 371 (c)(1),
(2) Date: Mar. 12, 2018

(87) PCT Pub. No.: WO2017/047154
PCT Pub. Date: Mar. 23, 2017

(65) Prior Publication Data

US 2018/0251288 A1 Sep. 6, 2018

(30) Foreign Application Priority Data

Sep. 16, 2015 (JP) ..... 2015-183341

(51) Int. Cl.
*B65D 83/00* (2006.01)
*B65D 35/28* (2006.01)
(Continued)

(52) U.S. Cl.
CPC ..... *B65D 83/00* (2013.01); *B05C 11/10* (2013.01); *B65D 35/285* (2013.01); *B65D 47/00* (2013.01); *B05C 17/00583* (2013.01)

(58) Field of Classification Search
CPC ..... B65D 35/285; B65D 83/00; B65D 35/28; B05C 17/00583
See application file for complete search history.

(56) References Cited

U.S. PATENT DOCUMENTS 5,215,218 A * 6/1993 Choi ..... B65D 35/285 141/355
5,318,203 A * 6/1994 Iaia ..... B65D 81/3288 222/94

(Continued)

FOREIGN PATENT DOCUMENTS

CN 103492276 A 1/2014
JP H06-509535 A 10/1994

(Continued)

OTHER PUBLICATIONS

International Search Report for PCT/JP2016/063780, dated Aug. 23, 2016.

(Continued)

*Primary Examiner* — J C Jacyna
(74) *Attorney, Agent, or Firm* — Squire Patton Boggs (US) LLP

(57) ABSTRACT

Providing a viscous material feed apparatus and a viscous material feed method capable of further reducing a viscous material remaining in a container, e.g., a bag, housing the viscous material.

A viscous material feed apparatus according to the present invention includes: a container (10) configured to include a bag body (11) with a housing space configured to house a viscous material and a spout (20) with a passage configured to deliver the viscous material in the housing space to outside; a squeeze portion (30) configured to squeeze the bag body toward the spout and move the viscous material in the housing space toward the spout; and a nozzle (40) having a hollow shape, the nozzle being configured to be freely (Continued)

inserted into the passage of the spout and withdrawn from the spout, the nozzle being configured to deliver the viscous material collected at the spout to outside.

5 Claims, 12 Drawing Sheets

(51) Int. Cl.

| | |
|---|---|
| ***B65D 47/00*** | (2006.01) |
| ***B05C 11/10*** | (2006.01) |
| *B05C 17/005* | (2006.01) |

(56) References Cited

U.S. PATENT DOCUMENTS

| | | | | |
|---|---|---|---|---|
| 5,848,730 | A * | 12/1998 | Kawase | A45D 19/02 222/94 |
| 6,659,309 | B2 * | 12/2003 | Friedman | B65D 35/28 222/102 |
| 6,752,264 | B2 * | 6/2004 | Versluys | B65D 75/5883 206/219 |
| 2012/0267394 | A1 * | 10/2012 | Pierson | A61C 9/0026 222/94 |
| 2014/0048557 | A1 | 2/2014 | Barron | |

FOREIGN PATENT DOCUMENTS

| | | | |
|---|---|---|---|
| JP | 2002-255285 | A | 9/2002 |
| JP | 2003-081288 | A | 3/2003 |
| JP | 2003-192050 | A | 7/2003 |
| JP | 2003-335391 | A | 11/2003 |
| JP | 2006-321537 | A | 11/2006 |
| JP | 2007-161254 | A | 6/2007 |
| JP | 2007-290729 | A | 11/2007 |
| WO | WO 2011/071897 | A2 | 6/2011 |

OTHER PUBLICATIONS

Extended European Search Report dated Sep. 17, 2018, in European Patent Application No. 16846027.7, 8 pages.

First Office Action dated Dec. 26, 2018, in Chinese Patent Application No. 201680053433.0, 14 pages.

International Preliminary Report on Patentability dated Mar. 29, 2018 in International Patent Application No. PCT/JP2016/063780, 15 pages.

Notification of Reasons for Refusal dated Mar. 5, 2019, in Japanese Patent Application No. 2015-183341, 7 pages.

* cited by examiner

VISCOUS MATERIAL FEED APPARATUS AND VISCOUS MATERIAL FEED METHOD

TECHNICAL FIELD

The present invention relates to a viscous material feed apparatus and a viscous material feed method.

BACKGROUND ART

Conventionally, as a sealing agent or an adhesive agent, a high-viscosity viscous material, e.g., reactive silicone, urethane resin, or epoxy resin, has been used. As described in Patent Literature 1, for example, such material is pumped in a state of being housed in an inner bag by a follower plate or a pressure plate and applied to a sealing surface or the like of a workpiece.

CITATION LIST

Patent Literature

Patent Literature 1: JP 2002-255285 A

SUMMARY OF INVENTION

However, in Patent Literature 1, the inner bag is pressed by the pressure plate or the like. Therefore, wrinkles are created when the inner bag pressed is contracted while applying the viscous material or the like. In addition, the adhesive agent can enter the wrinkled portions formed. In such case, there is a problem that a viscous material, e.g., an adhesive agent, remains in the wrinkled bag.

The present invention has been made to solve the aforementioned problem, and it is an object of the present invention to provide a viscous material feed apparatus and a viscous material feed method that can reduce a viscous material remaining in a container, e.g., a bag, housing the viscous material.

A viscous material feed apparatus according to the present invention, which solves the aforementioned problem, includes: a container configured to include a bag body with a housing space configured to house a viscous material and a spout with a passage configured to deliver the viscous material in the housing space to outside; a squeeze portion configured to squeeze the bag body toward the spout and move the viscous material in the housing space toward the spout; and a nozzle having a hollow shape, the nozzle being configured to be freely inserted into the passage of the spout and withdrawn from the spout, the nozzle being configured to deliver the viscous material collected at the spout to outside.

In addition, a viscous material feed method according to the present invention, which solves the aforementioned problem, includes: inserting a hollow nozzle to a passage inside a spout attached to a bag body housing a viscous material delivered to outside; squeezing the bag body to deliver the viscous material through a nozzle inserted into the passage of the spout; and withdrawing the nozzle from the spout of the bag body and inserting the nozzle into a different spout attached to a different bag body to deliver the viscous material housed in the different bag body.

DESCRIPTION OF EMBODIMENTS

Figure 1A:
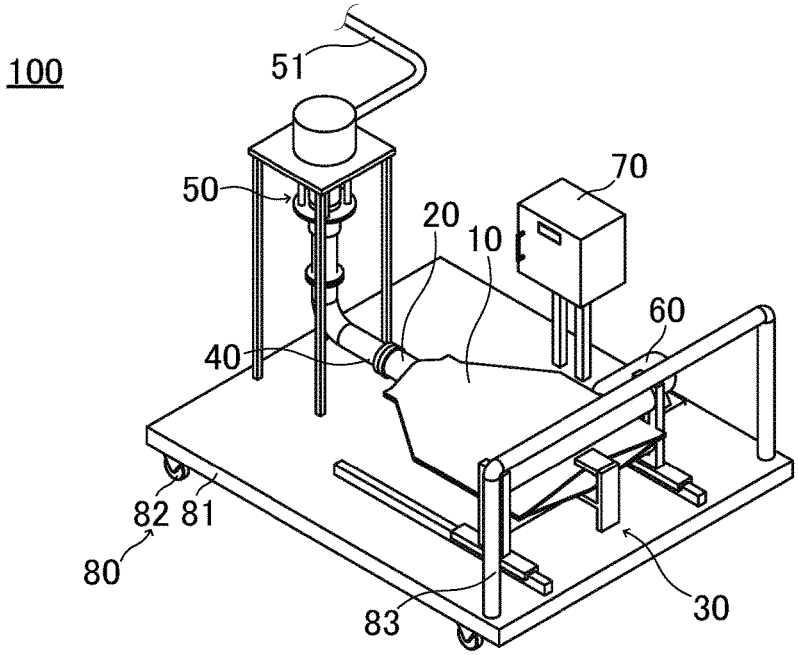
FIG. 1A is a perspective view illustrating a viscous material feed apparatus according to an embodiment of the present invention.

An embodiment of the present invention is described below with reference to the accompanying drawings. The description below does not limit the technical scope or the meanings of wordings stated of the claims. In addition, the proportion of dimensions in the drawings is exaggerated for the sake of convenience of description and may differ from the actual proportion.

Figure 1B:
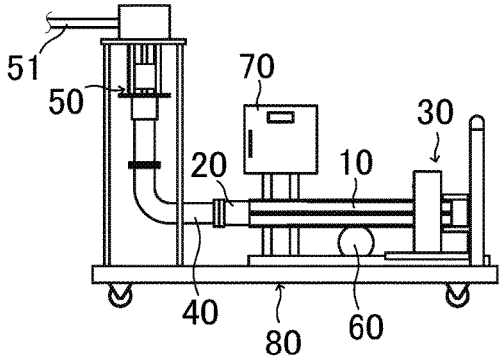
FIG. 1B is a front view illustrating a viscous material feed apparatus according to an embodiment of the present invention.
Figure 1C:
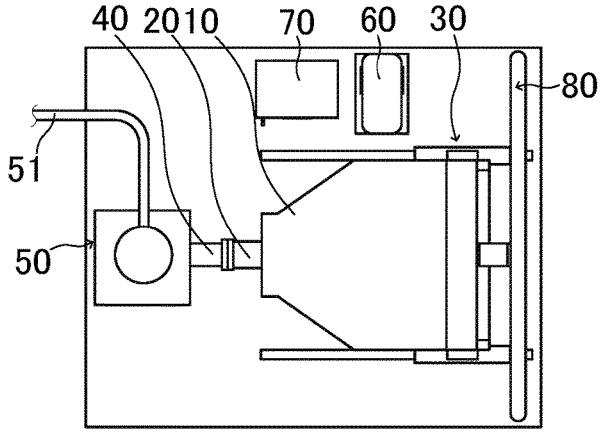
FIG. 1C is a plan view illustrating a viscous material feed apparatus according to an embodiment of the present invention.
Figure 2A:
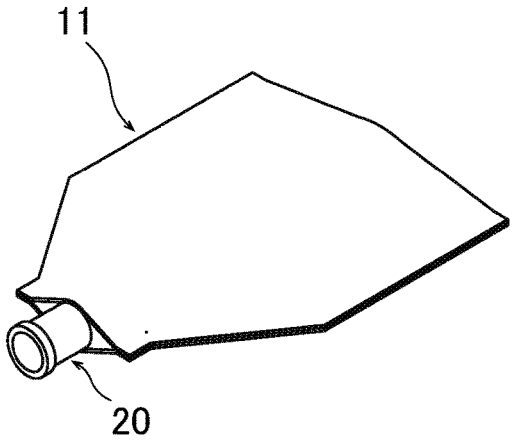
FIG. 2A is a perspective view illustrating a container.
Figure 2B:
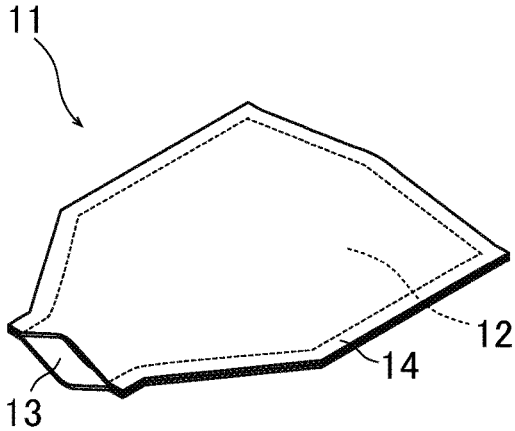
FIG. 2B is a perspective view illustrating a bag body obtained as a spout is removed from the container illustrated in FIG. 2A.
Figure 2C:
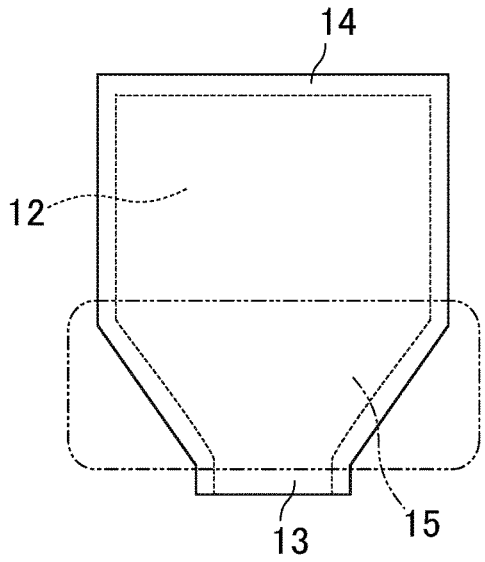
FIG. 2C is a plan view illustrating a bag body obtained as a spout is removed from the container illustrated in FIG. 2A.
Figure 2D:
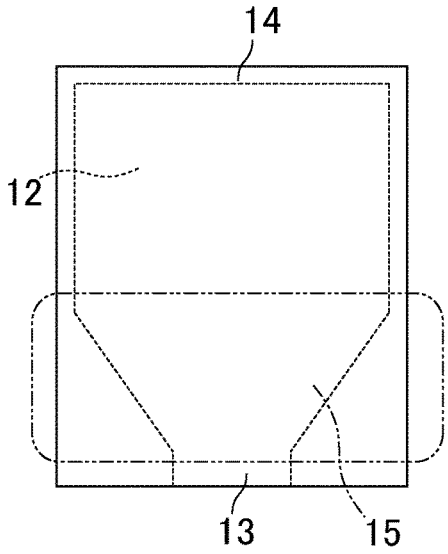
FIG. 2D is a plan view illustrating a variation of the bag body.

FIGS. 1A to 1C are a perspective view, a front view, and a plan view illustrating a viscous material feed apparatus according to an embodiment of the present invention, respectively. FIG. 2A is a perspective view illustrating a container. FIGS. 2B and 2C are a perspective view and a plan view illustrating a bag body obtained as a spout is removed from the container illustrated in FIG. 2A, respectively. FIG. 2D is a plan view illustrating a variation of a bag body.

(Viscous Material Feed Apparatus)

A viscous material feed apparatus 100 according to the present embodiment is used in feeding a high-viscosity viscous material, e.g., reactive silicone, urethane resin, or epoxy resin, as, for example, a sealing agent or an adhesive agent. The viscous material feed apparatus 100 is briefly described with reference to FIGS. 1A to 1C, 2A and 2B. The viscous material feed apparatus 100 includes a container 10 having a bag body 11 with an housing space 12 for housing a viscous material and a spout 20 with a passage 23 for delivering the viscous material in the housing space 12 to the outside, a squeeze portion 30 for squeezing the bag body 11 toward the spout 20 to move the viscous material in the housing space 12 toward the spout 20, and a nozzle 40 configured to be freely inserted into the passage 23 of the spout 20 and withdrawn from the spout 20 to deliver the viscous material collected at the spout 20 to the outside.

In addition, the viscous material feed apparatus 100 includes a pump 50 (corresponding to a pumping portion), which is connected to the nozzle 40 and pumps the viscous material delivered through the nozzle 40, a motor 60 connected to the squeeze portion 30 to squeeze the bag body 11, a control portion 70 for controlling the pump 50 and the motor 60, and a movement portion 80 configuring the viscous material feed apparatus 100 to be movable. A detailed description is given below.

(Bag Body)

The bag body 11 houses a high-viscosity viscous material, e.g., reactive silicone, urethane resin, or epoxy resin, as a sealing agent, an adhesive agent or the like. As illustrated in FIGS. 2A to 2C, the bag body 11 includes a housing space 12 formed as a space for housing the viscous material inside the bag body 11, an opening 13 for taking out the viscous material in the container to the outside, a welded portion 14 formed as portions excluding the opening 13 are sealed, and a reduction portion 15 formed in the housing space 12 such that the cross-sectional area of the housing space 12 is reduced toward the opening 13.

The bag body 11 is formed, for example, as, for example, two sheets of polyethylene or the like are prepared and the two sheets are welded at portions excluding the opening 13. The bag body 11 is formed as the two sheets are welded at portions excluding the opening 13, but the present invention is not limited thereto. In FIGS. 1A to 1C, the container is formed such that a sheet, which becomes a bottom surface, is arranged between the two sheets, and formation may be made in such a manner. In addition, as far as the viscous material can be housed, one sheet may be folded and the outer circumferential portions of the folded sheet piece may be welded at portions excluding the opening.

The housing space 12 is a space formed inside the bag body 11 and houses the viscous material to be delivered by the squeeze portion 30 or the like. Regarding the layered part of the sheets constituting the bag body 11, the opening 13 is a portion to which the spout 20 is attached. The opening 13 is provided at a part of the outer circumference of the portion where the two sheets are stacked together in the present embodiment. However, as far as the spout can be attached, the opening may be provided at a portion other than the portion where the sheets are stacked, e.g., the middle of the sheet constituting the bag body 11.

The welded portion 14 is a portion where a predetermined number of sheet materials are stacked and joined to form the housing space 12 in the bag body 11. In FIG. 2B or the like, the welded portion 14 is formed as the two sheets are stacked and the outer circumferential portions excluding the opening 13 are welded.

The reduction portion 15 is illustrated as the corresponding area is surrounded by the two-dot chain line in FIGS. 2C and 2D. The reduction portion 15 is a portion of the bag body 11 where the cross-sectional area of the housing space 12 is reduced in a direction in which the squeeze portion 30 is moved toward the spout 20 (a direction from top to bottom in FIG. 2C). In other words, the reduction portion 15 is a portion where the positions of both ends of the housing space 12 in plan view of the bag body 11 in FIG. 2C come close (taper) to the opening 13 toward the opening 13.

In FIG. 2C, similar to the shape of the housing space 12 of the bag body 11, the external shape of the bag body 11 at the reduction portion 15 is configured to be a shape tapering toward the opening 13. However, as far as the cross-sectional area of the housing space 12 is reduced toward the opening 13, unlike FIG. 2C, the external profile of the bag body 11 may be configured to be a rectangular sheet, as illustrated, for example, in FIG. 2D.

In addition, as far as squeezing can be performed with the squeeze portion 30, the external profile of the bag body 11 may be a shape other than that illustrated in FIG. 2C or 2D. The external profile of the reduction portion 15, which is illustrated as a solid line in FIG. 2C, may be configured to be a curved line as far as the viscous material in the container hardly remains.

(Spout)

FIGS. 3A to 3D area side view, a front view, a perspective view, and a bottom view illustrating a spout, respectively. As illustrated in FIGS. 3A to 3D, the spout 20 includes an outlet port 21 for the viscous material, the outlet port 21 being arranged outside when it is attached to the opening 13 of the bag body 11, an inlet port 22 for the viscous material, the inlet port 22 being positioned inside when it is attached to the opening 13, a passage 23, which connects the outlet port 21 and the inlet port 22 and through which the viscous material flows, a contact portion 24 for contacting squeeze members 31, 32 constituting the squeeze portion 30, and a joint portion 25 joined to the bag body 11.

The outlet port 21 is configured to have a cylindrical shape with an opening. The inlet port 22 communicates with the outlet port 21. The passage 23 has a hollow shape connecting the outlet port 21 and the inlet port 22. The viscous material from the housing space 12 flows to the aforementioned portion and is delivered to the outside.

Figure 3A:
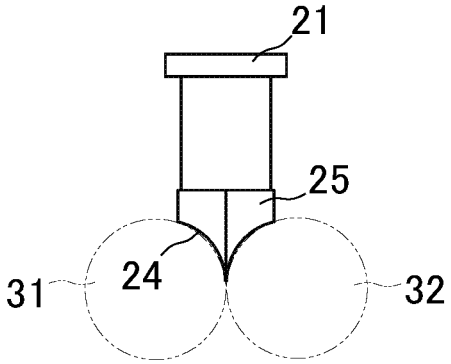
FIG. 3A is a side view illustrating a spout.
Figure 3B:
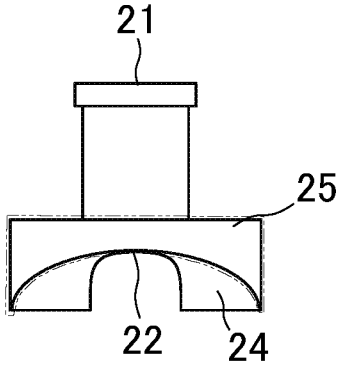
FIG. 3B is a front view illustrating a spout.
Figure 3C:
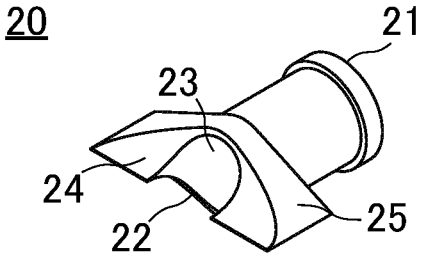
FIG. 3C is a perspective view illustrating a spout.
Figure 3D:
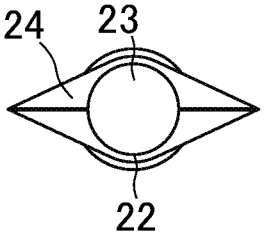
FIG. 3D is a bottom view illustrating a spout.

The joint portion 25 is a portion surrounded by the two-dot chain line in FIG. 3B and is formed at a portion that contacts the sheets constituting the bag body 11. The joint portion 25 is a side surface having a shape in which the width in the up-and-down direction in FIG. 3D increases toward the middle from the side.

The contact portion 24 is a portion that contacts the squeeze member 31 or squeeze member 32 constituting the squeeze portion 30 when the squeeze portion 30 is used to squeeze the bag body 11. Contact herein indicates that the squeeze members 31, 32 contact the contact portion 24 via the sheets constituting the bag body 11. The contact portion 24 has a surface having a shape that is the same or substantially the same as that of a part of the squeeze members 31, 32 so as to be capable of contact with the squeeze members 31, 32 with a minimum gap, and is configured to have a curved surface shape in the present embodiment.

An edge portion of the inlet port 22 is provided on the contact portion 24, and the inlet port 22 is contiguously formed from the contact portion 24. With such configuration, when the squeeze members 31, 32 are brought into contact with the contact portion 24 to move the viscous material in the housing space 12, the viscous material from the housing space 12 hardly remains and flows into the passage 23 of the spout 20.

In addition, the contact portion 24 is a portion, which is not welded to the sheets constituting the bag body 11. The ratio of the surface areas of the joint portion 25 and the contact portion 24 of the spout 20 may be configured, in one example, to be 2.8:7.2.

(Squeeze Portion)

Figure 6A:
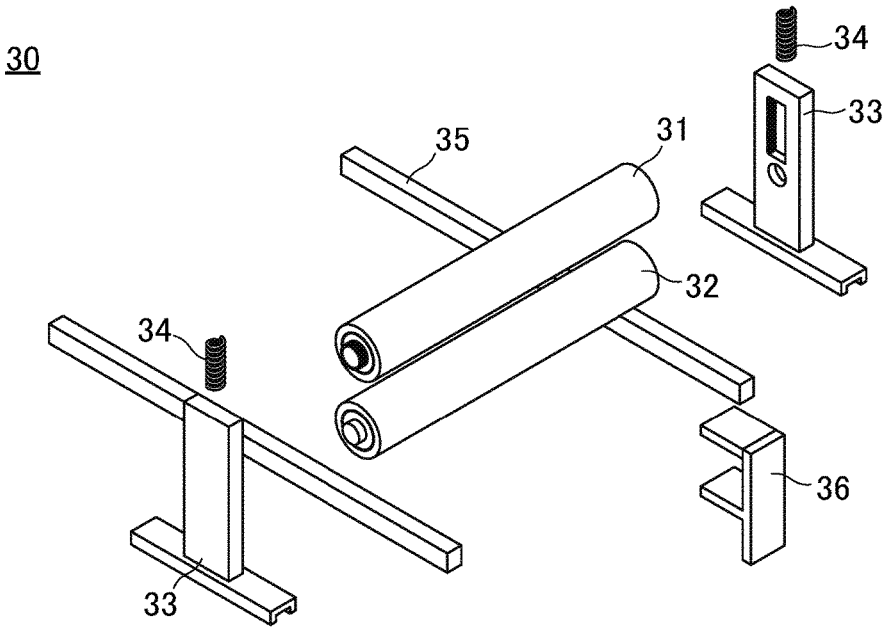
FIG. 6A is an exploded perspective view illustrating the configuration of a squeeze portion.
Figure 6B:
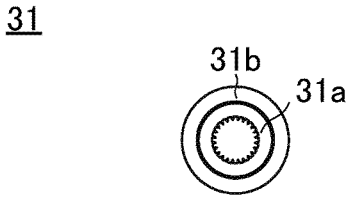
FIG. 6B is a front view illustrating a movable squeeze member constituting a squeeze portion.
Figure 6C:
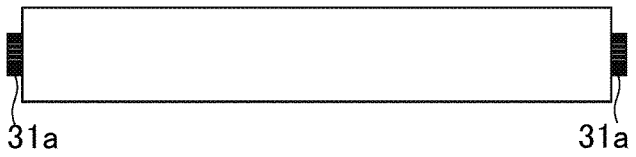
FIG. 6C is a side view illustrating a movable squeeze member constituting a squeeze portion.
Figure 6D:
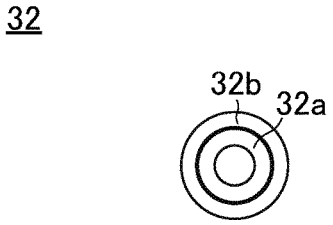
FIG. 6D is a front view illustrating a fixed squeeze member constituting a squeeze portion.
Figure 6E:
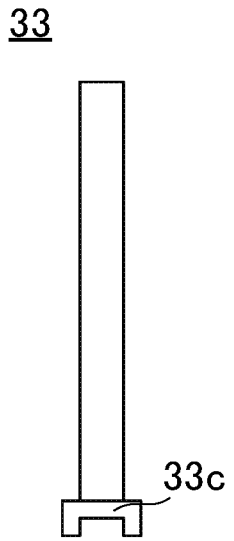
FIG. 6E is a side view illustrating an attachment member constituting a squeeze portion.
Figure 6F:
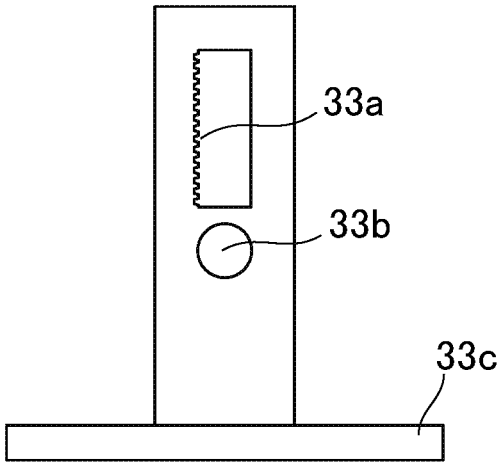
FIG. 6F is a front view illustrating an attachment member constituting a squeeze portion.
Figure 7:
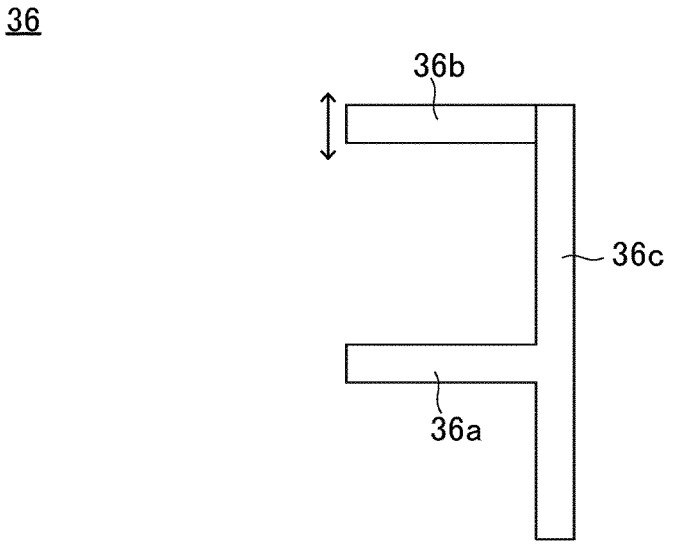
FIG. 7 is a front view illustrating a holding portion constituting a squeeze portion.

FIG. 6A is an exploded perspective view illustrating the configuration of the squeeze portion. FIGS. 6B and 6C are a front view and a side view illustrating a movable squeeze member constituting the squeeze portion, respectively. FIG. 6D is a front view illustrating a fixed squeeze member constituting the squeeze portion. FIGS. 6E and 6F are a side view and a front view illustrating an attachment member constituting the squeeze portion, respectively. FIG. 7 is a front view illustrating a holding portion constituting the squeeze portion.

The squeeze portion 30 is used to deliver the viscous material housed in the bag body 11 to the outside. As illustrated in FIGS. 6A to 6F and 7, the squeeze portion 30 includes a pair of squeeze members 31, 32 for squeezing the bag body 11, a pair of attachment members 33 to which the squeeze members 31, 32 are attached, respectively, resilient members 34 for providing a resilient force to press the squeeze member 31 against the squeeze member 32 to squeeze the bag body 11, a pair of linear guides 35 for moving the attachment members 33 relative to the bag body 11, and a holding portion 36 for holding the bag body 11.

As illustrated in FIGS. 6A to 6D, the squeeze portion 30 is configured to include the pair of squeeze members 31, 32 having a cylindrical shape as a feature for squeezing the bag body 11. The squeeze member 31 is configured to be capable of moving toward and away from the squeeze member 32. The squeeze member 31 is configured to be capable of adjusting the distance from the squeeze member 32 along an attachment portion 33*a* formed on the attachment member 33 illustrated in FIG. 6F.

As illustrated in FIGS. 6B and 6C, the squeeze member 31 includes attachment portions 31*a* attached to the attachment members 33, and a rotary portion 31*b*, which is formed of a member different from the attachment portions 31*a*, arranged outside the attachment portions 31*a*, and enables rotation of the squeeze member 31 when the attachment members 33 are moved relative to the bag body 11.

The attachment portions 31*a* are a shaft portion positioned at a central part of the squeeze member 31. The attachment portions 31*a* have a pinion-like teeth shape that meshes with a rack-like shape formed on the attachment members 33. The aforementioned configuration of the attachment portions 31*a* enables adjustment in distance between the squeeze member 31 and the squeeze member 32.

The rotary portion 31*b* is formed as a member different from the attachment portions 31*a*. When bearings, for example, are arranged between the attachment portions 31*a* and the rotary portion 31*b*, the rotary portion 31*b* is configured to be rotatable independently of the operation of the attachment portions 31*a*. When the squeeze member 31 is configured in the manner described above, as the attachment members 33 are used to move the squeeze member 31, the rotary portion 31*b* is configured to squeeze the bag body 11 while rotating.

As illustrated in FIG. 6D, the squeeze member 32 includes an attachment portion 32*a* and a rotary portion 32*b*. Unlike the squeeze member 31, the squeeze member 32 is fixedly attached to the attachment members 33. Therefore, unlike the squeeze member 31, the shaft portion does not have a pinion-like tooth-shaped profile. However, the present invention is not limited to the above, but similar to the squeeze member 31, a rack-like teeth-shaped profile may be provided. The rotary portion 32*b* is similar to the rotary portion 31*b* of the squeeze member 31 and is therefore not elaborated.

In addition, in FIG. 6A or the like, it is configured such that the squeeze members 31, 32 are included, but the present invention is not limited thereto. As far as the bag body 11 can be squeezed, it may be configured such that the bag body 11 is placed on a flat plate and one squeeze member squeezes to press from the above. In addition, in the present embodiment, the squeeze members 31, 32 are so-called rollers, which perform squeeze operation while rotating in the manner described above. However, the present invention is not limited thereto, but, unlike the above, may be configured to perform squeeze operation without rotation. In this case, the shape of the squeeze member may not be a cylindrical shape, but may be configured to be, for example, a polygonal shape in cross-section.

The attachment members 33 are attached to the ends of the squeeze members 31, 32 to make the squeeze members 31, 32 movable. As illustrated in FIGS. 6E and 6F, the attachment member 33 includes the attachment portion 33*a* to which the squeeze member 31 is attached and which enables adjustment in distance between the squeeze member 31 and the squeeze member 32, an attachment portion 33*b* to which the squeeze member 32 is attached, and a rail attachment portion 33*c* for movably attaching the attachment member 33 to the linear guide 35.

The attachment portion 33*a* is provided on a side surface of the attachment member 33 and is provided on an inner side obtained when the attachment member 33 is arranged on the linear guide 35. The attachment portion 33*a* is configured as a rack-shaped groove on which the squeeze member 31 is moved is formed, but the present invention is not limited to the aforementioned configuration as far as the distance between the squeeze member 31 and the squeeze member 32 can be adjusted.

In addition, the resilient member 34 is attached to the attachment portion 33*a*. The resilient member 34 prevents or suppresses a reduction in pressing force to the bag body 11 due to the reaction force generated when the squeeze member 31 presses the bag body 11 together with the squeeze member 32. The resilient member 34 has one end attached to the attachment portion 33*a* of the attachment member 33 and the other end attached to the squeeze member 31, exerting a resilient force (elastic force) for pressing the squeeze member 31 against the squeeze member 32. In the present embodiment, as illustrated in FIG. 6A, the resilient member 34 is formed of a spring, which is an elastic member, but may use a feature other than a spring as far as a reduction in pressing force of the squeeze members 31, 32 can be prevented or suppressed.

The attachment portion 33*b* is a feature for attaching the squeeze member 32 and is configured to have a recessed shape for attaching the shaft part of the squeeze member 32. However, the shape is not limited to a recessed shape as far as the squeeze member 32 can be attached. The rail attachment portion 33*c* is a feature for moving the attachment member 33 on the linear guide 35 and is attached to the linear guide 35.

As illustrated in FIG. 6A, the linear guides 35 have a rail shape for moving the attachment members 33 to which the squeeze members 31, 32 are attached. However, as far as the attachment members 33 can be moved, the configurations of the rail attachment portions 33*c* and the linear guides 35 are not limited to the above.

The holding portion 36 is used to prevent that the bag body 11 cannot be squeezed by being deformed by the movement of the squeeze members 31, 32 when the squeeze members 31, 32 squeeze the bag body 11. The holding portion 36 holds and retains the end of the bag body 11 substantially opposite the position where the spout 20 is attached.

As illustrated in FIG. 7, the holding portion 36 includes a fixed portion 36*a* for contacting the surface of the bag body 11 to hold the bag body 11, a movable portion 36*b* configured to contact the surface of the bag body 11 opposite the surface for contacting the fixed portion 36*a* and to move toward and away from the fixed portion 36*a*, and an attachment portion 36*c* to which the fixed portion 36*a* is attached and the movable portion 36*b* is attached movably.

The fixed portion 36*a* is substantially horizontally attached to the attachment portion 36*c*, but the attachment aspect is not limited to horizontal as far as it can hold the bag body 11 together with the movable portion 36*b*. The movable portion 36*b* is attached to the attachment portion 36*c* to be movable with a drive source, which is not illustrated. The attachment portion 36*c* is disposed on the linear guide 35 in an upright state. The attachment portion 36*c* is fixedly disposed. However, similar to the attachment member 33, it may be configured to be movable to hold, for example, the end of containers of various sizes.

(Nozzle)

Figure 4A:
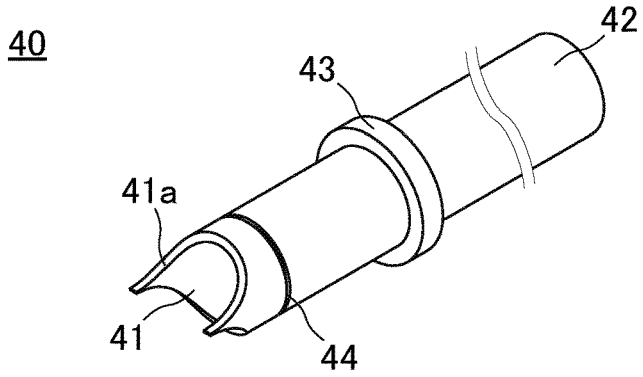
FIG. 4A is a perspective view illustrating a nozzle.
Figure 4B:
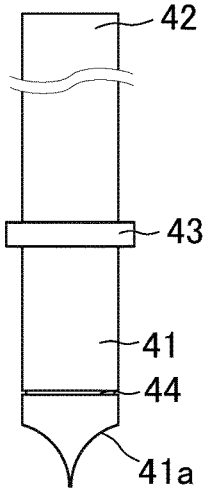
FIG. 4B is a side view illustrating a nozzle.
Figure 4C:
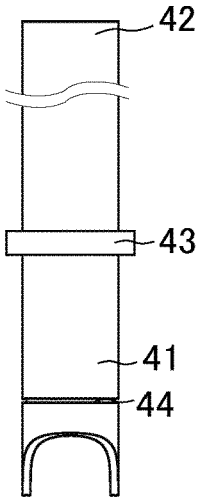
FIG. 4C is a front view illustrating a nozzle.
Figure 5A:
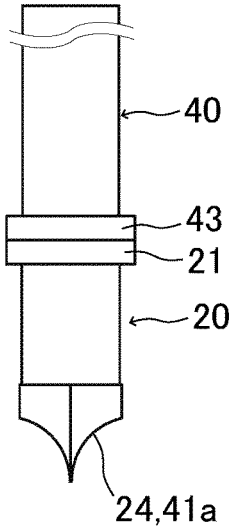
FIG. 5A is a side view illustrating a state in which a nozzle is attached to a spout.
Figure 5B:
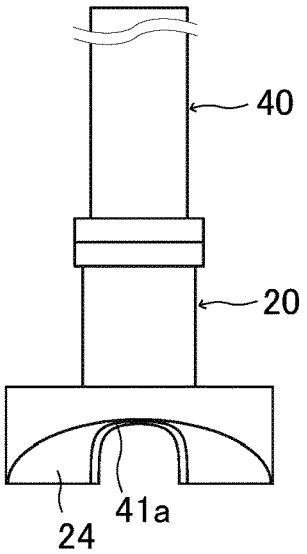
FIG. 5B is a front view illustrating a state in which a nozzle is attached to a spout.
Figure 5C:
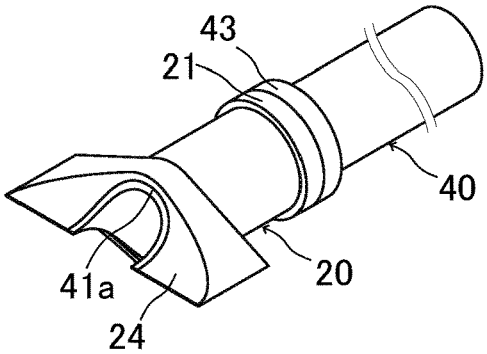
FIG. 5C is a perspective view illustrating a state in which a nozzle is attached to a spout.
Figure 5D:
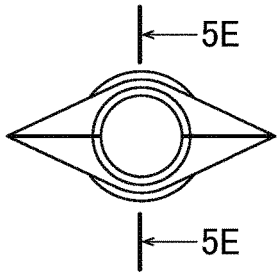
FIG. 5D is a bottom view illustrating a state in which a nozzle is attached to a spout.
Figure 5E:
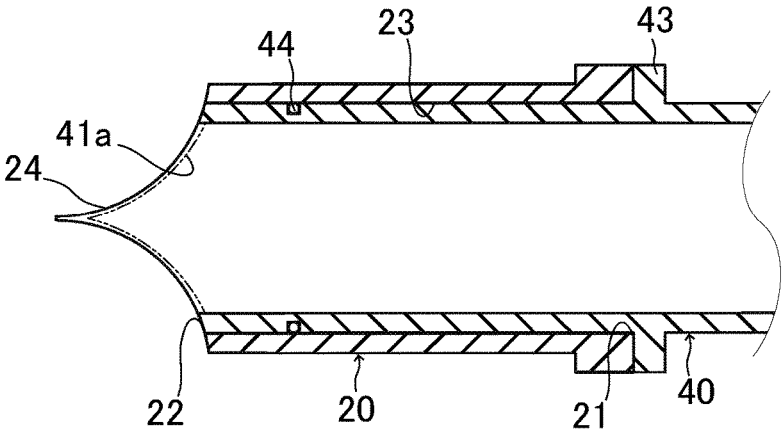
FIG. 5E is a cross-sectional view along line 5E-5E of FIG. 5D.

FIGS. 4A to 4C are a perspective view, a side view, and a front view illustrating a nozzle, respectively. FIGS. 5A to 5D are a side view, a front view, a perspective view, and a bottom view illustrating a state in which a nozzle is attached to a spout, respectively. FIG. 5E is a cross-sectional view along line 5E-5E of FIG. 5D.

The nozzle 40 is inserted into the spout 20 for delivery of the viscous material in the bag body 11 to the outside. As illustrated in FIGS. 4A to 4C, the nozzle 40 includes a spout insertion portion 41, a pump connection portion 42, a flange 43 for determining the position of the insertion direction of the nozzle 40 with respect to the spout 20, and an attachment groove 44 to which a sealing member for sealing between the nozzle 40 and the spout 20 is attached.

The nozzle 40 is formed to have a hollow substantially cylindrical shape with an opening. The spout insertion portion 41 is provided at a relatively end of the cylindrical shape and corresponds to a portion that is inserted into the spout 20. The spout insertion portion 41 is configured to have an outside diameter that is substantially the same diameter as the inside diameter of the passage 23 of the spout 20. In addition, the spout insertion portion 41 has an end portion 41*a* (corresponding to the contact portion) positioned on the endmost side.

The end portion 41*a* is configured to be substantially flush with the surface of the contact portion 24 of the spout 20 when the flange 43 is abutted with the flange of the outlet port 21 of the spout 20. The end portion 41*a* contacts the squeeze members 31, 32 via the sheets of the bag body 11 in a state of being substantially flush with the contact portion 24.

Contact herein has the same meaning as that described with regard to the contact portion 24 of the spout 20. In addition, in FIG. 5E, the contact portion 24 and the end portion 41*a* overlap. In order to illustrate the contact portion 24 and the end portion 41*a* distinctively, the line of the end portion 41*a* is designed to be slightly displaced from the line of the contact portion 24 and illustrated by the two-dot chain line.

The flange 43 is provided at a position such that the end portion 41*a* is substantially flush with the contact portion 24 when the nozzle 40 is inserted into the spout 20 as described above. The pump connection portion 42 is a portion that is positioned on the base side of the nozzle 40 and connected to the pump 50, and has a shape that is the same as a conventionally known one and is not elaborated. As illustrated in FIGS. 4C, 5E and the like, the attachment groove 44 has a groove shape, which is provided on the outer side surface of the substantially cylindrical shape and to which a sealing member, e.g., an O-ring, is attached.

(Other Constituent Elements)

As illustrated in FIGS. 1A to 1C, the pump 50 pumps the viscous material delivered through the nozzle 40, which is inserted into the spout 20, via a pipe 51 or the like. As the pump 50, for example, a plunger pump, a gear pump, or a screw pump may be adopted, but the present invention is not limited thereto.

The motor 60 is a feature for supplying power for operating the squeeze members 31, 32 constituting the squeeze portion 30, and the attachment members 33, and is not elaborated because it is the same as conventionally known one. The control portion 70 includes a CPU, a memory, an I/O interface and the like for operating the pump 50 and the motor 60.

As illustrated in FIG. 1A or the like, the movement portion 80 includes a placement portion 81 on which the squeeze portion 30, the motor 60, and the pump 50 are disposed, rollers 82 for configuring the placement portion 81 to be movable, and a handle portion 83 for movement of the viscous material feed apparatus 100 by humans or the like.

The placement portion 81 is formed of a plate material or the like formed of metal. The rollers 82 are rollers disposed on the four corners of the lower part of the placement portion 81, enabling movement of the viscous material feed apparatus 100. The handle portion 83 is configured as, for example, a metal pipe shape is attached to an upper part of the placement portion 81, and is a handle portion for movement of the viscous material feed apparatus 100 by humans or the like.

(Viscous Material Feed Method)

Figure 8:
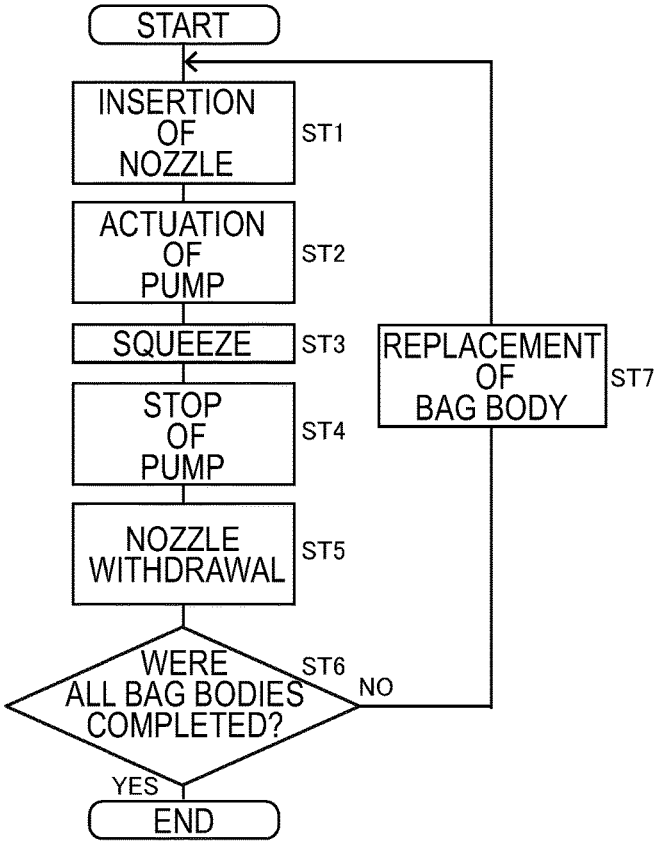
FIG. 8 is a flowchart describing a viscous material feed method according to an embodiment of the present invention.
Figure 9A:
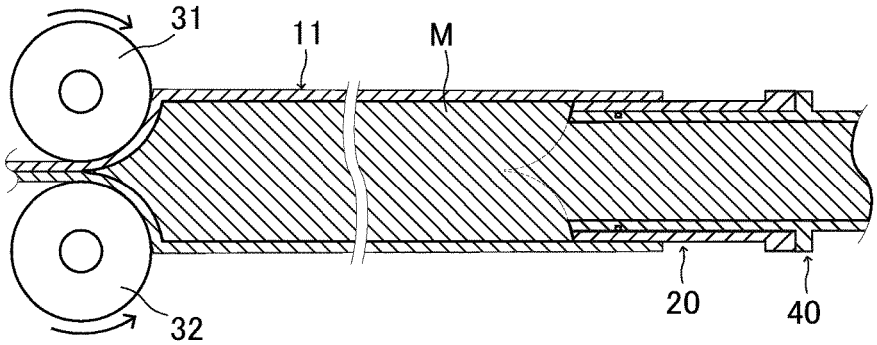
FIG. 9A is a view describing a state of delivering a viscous material housed in a bag body.
Figure 9B:
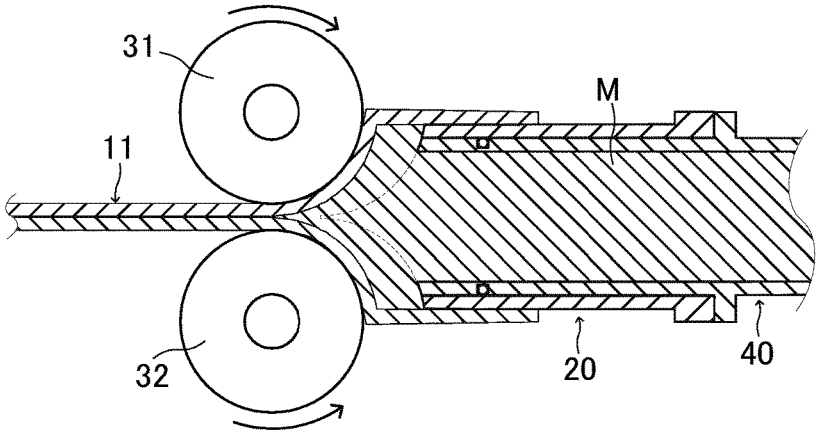
FIG. 9B is a view describing a state of delivering a viscous material housed in a bag body.
Figure 9C:
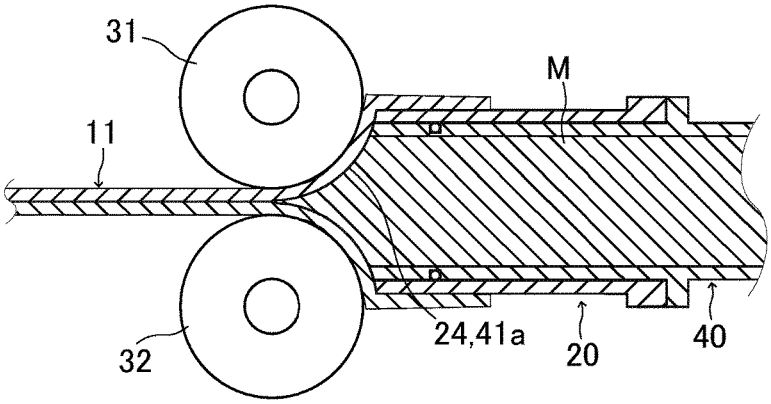
FIG. 9C is a view describing a state of delivering a viscous material housed in a bag body.
Figure 10:
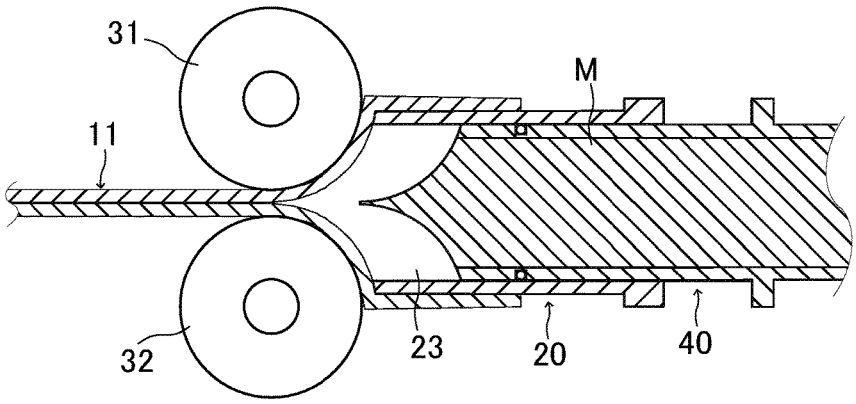
FIG. 10 is a view describing a state of removing a nozzle from a spout.
Figure 11:
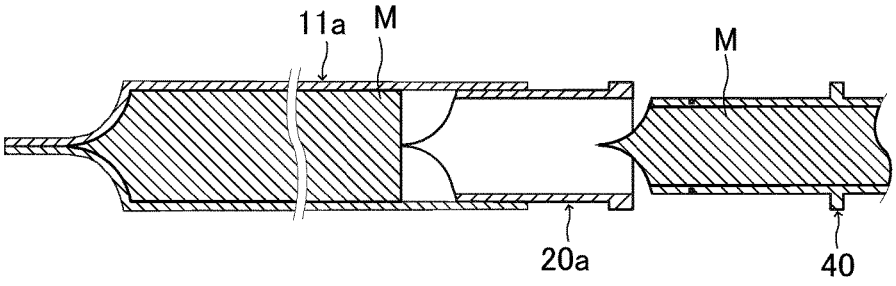
FIG. 11 is a view describing a state of inserting a nozzle to a new (different) container.

Next, a viscous material feed method according to the present embodiment is described. FIG. 8 is a flowchart describing a viscous material feed method according to an embodiment of the present invention. FIGS. 9A to 9C are views describing a state of delivering a viscous material housed in a bag body. FIG. 10 is a view describing a state of delivering a nozzle from a spout. FIG. 11 is a view describing a state of inserting a nozzle into a new (different) container.

The viscous material feed method is briefly described with reference to FIG. 8. The viscous material feed method includes insertion of the nozzle 40 to the spout 20 (step ST1), actuation of the pump 50 (step ST2), squeeze operation of the squeeze portion 30 (step ST3), stop of the pump 50 (step ST4), and withdrawal of the nozzle 40 (step ST5).

First, as illustrated in FIGS. 5A to 5E, the nozzle 40 is inserted and attached to the passage 23 of the spout 20, and the end opposite to the spout 20 is held and set by the holding portion 36 (step ST1). Then, the pump 50 is actuated (step ST2).

Next, as illustrated in FIGS. 9A and 9B, while the state in which the squeeze members 31, 32 are used to press and hold the bag body 11 is maintained, the attachment members 33 are moved toward the spout 20 on the linear guides 35 to perform the squeeze operation. Thus, a viscous material M present in parts of the housing space 12 of the bag body 11 excluding the circumference of the spout 20 is moved toward the spout 20.

Furthermore, the viscous material M present in the housing space 12 is delivered to the outside through the nozzle 40 inserted into the spout 20. As illustrated in FIG. 9C, the squeeze operation is completed when the squeeze members 31, 32 contact the contact portion 24 of the spout 20 and the end portion 41*a* of the spout insertion portion 41 of the nozzle 40 via the sheets of the bag body 11 (step ST3). The viscous material M delivered through the nozzle 40 is pumped by the pump 50.

Next, the pump 50 is stopped (step ST4). After the pump 50 is stopped, as illustrated in FIG. 10, the nozzle 40 is withdrawn from the spout 20 (step ST5). Thus, the viscous material M, which would otherwise conventionally remain in the passage 23 of the spout 20, is removed in a state of being introduced inside the nozzle 40.

In cases where the viscous material M in an amount corresponding to a number of bag bodies 11 is delivered, when the delivery of the viscous material M from all the bag bodies 11 is not completed (step ST6: NO), the bag body 11 is replaced with a new one (step ST7). Then, until the delivery of the viscous material M from all the bag bodies 11 is completed (step ST6: YES), as illustrated in FIG. 11, the operation from the insertion of the nozzle 40, in which the viscous material M is housed inside (step ST1), into a spout 20*a* attached to a new bag body 11*a* filled with the viscous material M, to the withdrawal of the nozzle 40 (step STS) is repeated.

(Functional Effect)

Next, a functional effect according to the present embodiment is described. In the present embodiment, the squeeze portion 30 is used to squeeze the bag body 11 to prevent the creation of wrinkles on the bag body 11, preventing the viscous material M from remaining in the bag body 11 by prevention of wrinkles. In addition, in the present embodiment, it is configured such that not only does the squeeze portion 30 squeeze the bag body 11, but the nozzle 40 is inserted into the passage 23 of the spout 20 to introduce and withdraw the viscous material M remaining in the passage 23 of the spout 20 into the nozzle 40, and the nozzle 40 is inserted into a different spout 20*a* attached to a new bag body 11*a* filled with the viscous material M to perform delivery of the viscous material M. Therefore, the viscous material M remaining in the passage 23 of the spout 20, which cannot be delivered by the squeeze portion 30 only, can be delivered. Thus, the viscous material M remaining inside the container 10 can be further reduced.

In addition, the spout 20 is configured to include the contact portion 24 having a shape that corresponds to the cylindrical shape of the squeeze members 31, 32 constituting the squeeze portion 30. Therefore, the space formed between the sheets constituting the bag body 11 and the spout 20 when the squeeze members 31, 32 are moved to contact the spout 20 can be close to 0 (zero). Thus, the viscous material M remaining between the sheets of the bag body 11 and the spout 20 can be reduced, enabling a reduction in viscous material M remaining in the container 10.

In addition, the nozzle 40 is configured to include the end portion 41*a* having a shape that corresponds to the cylindrical shape of the squeeze members 31, 32 constituting the squeeze portion 30. Therefore, similar to the contact portion 24 of the spout 20, the viscous material M remaining between the sheets of the bag body 11 and the nozzle 40 can be reduced when the squeeze members 31, 32 contact the spout 20. Thus, the viscous material M remaining inside the container 10 can be reduced.

In addition, the viscous material feed apparatus 100 is configured to include the pump 50 for pumping the viscous material M delivered through the nozzle 40. Therefore, the viscous material M delivered from the bag body 11 can be fed efficiently.

In addition, the bag body 11 is configured to include the reduction portion 15 in which the cross-sectional area of the housing space 12 is reduced toward the spout 20. Therefore, the viscous material M in the housing space 12 can be efficiently led to the spout 20 when the squeeze members 31, 32 are used to squeeze the bag body 11, enabling a further reduction in viscous material M remaining in the bag body 11 constituting the container 10.

In addition, as described with regard to the viscous material feed method, when it is configured such that the pump 50 is stopped before the withdrawal of the nozzle 40 from the spout 20, air hardly enters the viscous material M housed inside the nozzle 40. Thus, the viscous material M can be delivered efficiently.

The present invention is not limited to the aforementioned embodiment, but various changes may be made within the scope of the claims.

In the above, the embodiment in which the viscous material feed apparatus 100 includes the movement portion 80 is described, but the present invention is not limited thereto, and the viscous material feed apparatus 100 may be configured not to include the movement portion 80 when it is a stationary type. In addition, in the above, the embodiment in which the bag body 11 is placed in a horizontal or laid-down state is described, but the present invention is not limited thereto, and the bag body 11 may be configured to be arranged in an upright state.

In addition, as illustrated in FIGS. 5A to 5E, the outer side surface of the nozzle 40 is configured to have substantially the same diameter as the inside diameter of the outlet port 21 of the spout 20, but the present invention is not limited thereto. As far as the viscous material M remaining inside the spout 20 can be introduced into the nozzle 40, a gap may be formed in a radiation direction or a radial direction between the outer side surface of the nozzle 40 and the inner circumferential surface of the passage 23 of the spout 20. Even in such case, as compared with the case where the nozzle 40 is not arranged inside the passage 23 of the spout 20, the viscous material M remaining inside the passage 23 of the spout 20 constituting the container 10 can be reduced.

In addition, the embodiment in which the end portion 41*a* of the nozzle 40 is flush with the contact portion 24 when the flange 43 is abutted with the flange of the outlet portion 21 of the spout 20 is described, but the present invention is not limited thereto. The end portion 41*a* may be configured not to be flush with the contact portion 24, but to be positioned inside the passage 23 of the spout 20, which is spaced from the housing space 12 of the bag body 11 relative to the contact portion 24 when the nozzle 40 is attached to the spout 20. Even in such case, as compared with the case where the nozzle 40 is not arranged inside the passage 23 of the spout 20, the viscous material M remaining inside the passage 23 of the spout 20 constituting the container 10 can be reduced.

The disclosure of Japanese Patent Application No. 2015-183341 filed on Sep. 16, 2015 is incorporated herein by reference in its entirety.

REFERENCE SIGNS LIST

10 container
11, 11*a* bag body
12 housing space
15 reduction portion
100 viscous material feed apparatus
20, 20*a* spout
23 passage
24 contact portion
30 squeeze portion
31 (movable) squeeze member
32 (fixed) squeeze member
40 nozzle
41*a* end portion (contact portion)
50 pump (pumping portion)
M viscous material

The invention claimed is:

1. A viscous material feed apparatus comprising:

a container configured to include a bag body with a housing space configured to house a viscous material and a spout with a passage configured to deliver the viscous material in the housing space to outside;

a squeeze portion configured to squeeze the bag body toward the spout and move the viscous material in the housing space toward the spout; and a nozzle having a hollow shape, the nozzle being configured to be freely inserted into the passage of the spout and withdrawn from the spout, the nozzle being configured to deliver the viscous material collected at the spout to outside, wherein the nozzle has a contact portion having a shape corresponding to a shape of the squeeze portion.

2. The viscous material feed apparatus according to claim 1, wherein the spout has a contact portion having a shape corresponding to a shape of the squeeze portion.

3. The viscous material feed apparatus according to claim 1, further comprising a pumping portion configured to pump the viscous material delivered through the nozzle.

4. The viscous material feed apparatus according to claim 1, wherein the bag body further comprises a reduction portion in which a cross-sectional area of the housing space is reduced toward the spout.

5. A viscous material feed method using the viscous material feed apparatus according to claim 1, the method comprising:

inserting the nozzle having a hollow shape to the passage inside the spout attached to the bag body housing the viscous material delivered to outside;

squeezing the bag body to deliver the viscous material through the nozzle inserted into the passage of the spout; and withdrawing the nozzle from the spout of the bag body and inserting the nozzle into a different spout attached to a different bag body to deliver the viscous material housed in the different bag body.

* * * * *